United States Patent [19]

Rasmussen

[11] 4,117,683

[45] Oct. 3, 1978

[54] SYSTEM AND METHOD FOR COOLING HOT WATER FROM INDUSTRIAL PLANT COOLING USE

[76] Inventor: Ross H. Rasmussen, R.F.D. #2, Hooper, Nebr. 68031

[21] Appl. No.: 762,205

[22] Filed: Jan. 24, 1977

[51] Int. Cl.[2] ..... E02B 3/00

[52] U.S. Cl. ..... 405/61; 405/52; 165/45

[58] Field of Search ..... 61/1 R, 63; 165/45, 165/14; 137/566

[56] References Cited

U.S. PATENT DOCUMENTS

| | | | |
|---|---|---|---|
| 3,061,276 | 10/1962 | Homan | 165/45 X |
| 3,747,907 | 7/1973 | Anderson | 165/45 X |
| 3,927,531 | 12/1975 | Mikolics et al. | 165/45 X |
| 4,031,952 | 6/1977 | Contour | 165/45 X |

*Primary Examiner*—Dennis L. Taylor

*Attorney, Agent, or Firm*—Merriam, Marshall & Bicknell

[57] ABSTRACT

A system for thermal disposal and port improvement comprising an industrial plant constituting a source of hot cooling water which must be cooled located along a navigable river, lake or ocean, a body of water constituting a port in the vicinity of the industrial plant and in navigable communication with the river, lake or ocean, means for delivering hot cooling water from the industrial plant to the port water to cool the water throughout the year and to prevent it from freezing shut in winter, and means for removing cool cooling water from the port water and delivering it to the industrial plant and/or to a river, lake or ocean.

A method of cooling hot cooling water from an industrial plant, which comprises removing hot cooling water as an effluent stream from an industrial plant, directing the stream of hot cooling water to the top portion of a holding and cooling lake open to the atmosphere to effect reduction of the temperature of the hot cooling water by evaporation and conduction, and withdrawing cool cooling water from the bottom portion of the lake and sending it back to the industrial plant for cooling purposes and/or to a river, lake, or ocean.

27 Claims, 8 Drawing Figures

SYSTEM AND METHOD FOR COOLING HOT WATER FROM INDUSTRIAL PLANT COOLING USE

This invention relates to methods and systems for cooling large volumes of hot water. More particularly, this invention is concerned with the cooling of large volumes of hot water constituting an effluent stream from an industrial plant, and then reusing the water for plant cooling operations.

Many industrial plants require large amounts of cooling water during their operation. This is particularly true of electric generating plants, oil refineries and steel making plants. The cooling water used in such industrial plants is generally withdrawn from a river or lake. Generally, the cooling water is fresh water. Salt water from an ocean is generally not employed because the salinity has a highly corrosive effect on the plant equipment. In performing its function the cooling water becomes hot and the hot cooling water cannot be reused for cooling purposes until it is reduced in temperature. In addition, the present environmental laws prohibit discharging hot cooling water into a river, lake or ocean without substantially cooling it beforehand. The hot cooling water must therefore be substantially cool, whether it is reused for industrial plant cooling purposes or before it is returned to a river, lake or ocean.

Large natural draft concrete cooling towers are used to a considerable extent to reduce the temperature of hot cooling water. Cooling towers, however, require large capital investments and high operating costs. They are also considered to have only a twenty year useful life before they must be replaced. Furthermore, large amounts of water are lost to the atmosphere by use of cooling towers and unsightly clouds form on the downwind side of the tower, which in winter time can lead to icing of the surrounding area.

Some industrial plants, including electric generating stations, already use rather large lakes, including man-made lakes, to receive hot cooling water so that it may be cooled substantially before it is returned to a river, lake or ocean, or before the so-cooled water is reused for cooling purposes in the industrial plant. The means used to feed the hot water to the lake and to withdraw the cooled water from the lake are generally rather unsophisticated and do not effect efficient cooling. Accordingly, improved systems and methods are needed for delivering the hot cooling water to a cooling lake and then withdrawing it from the lake after it is cooled to either return the cooled water to the industrial plant or to return it to a river, lake or ocean. Furthermore, it is desired that the improved methods and systems serve not only to cool hot cooling water but that the cooling lake serve an additional one or more useful purposes.

According to one aspect of the subject invention there is provided a method of cooling hot cooling water from an industrial plant which comprises removing hot cooling water as an effluent stream from an industrial plant, directing the stream of hot water to the top portion of a holding and cooling lake open to the atmosphere to effect reducing the temperature of the hot water by evaporation and conduction, and withdrawing cool water from the bottom portion of the lake and sending it back to the industrial plant for industrial cooling purposes or to a river, lake or ocean. Advisably, the hot cooling water is fed to the top portion of one side of the lake to form a hot cooling water layer thereon which flows partially or wholly across the lake, and the cool cooling water is withdrawn from the bottom portion of the opposite side of the lake.

There is also provided by the invention a system for thermal disposal and port improvement comprising, a combination of an industrial plant constituting a source of hot cooling water which must be cooled located along a navigable river, lake or ocean, a body of water constituting a port in the vicinity of the industrial plant and in navigable communication with the river, lake or ocean, means for delivering hot cooling water from the industrial plant to the port water to cool the hot cooling water therein throughout the year and by heat exchange with the water in the lake to prevent it from freezing shut in cold weather, such as during the winter, and means for delivering cool cooling water from the port or lake water to the industrial plant or to a river, lake or ocean, or to both an industrial plant and to a river, lake or ocean. The hot cooling water is desirably delivered to the top portion of the port or lake water and the cool cooling water is removed from the bottom portion of the port or lake water.

In a further important aspect of the invention there is provided in combination, an electric power generating station, a natural body of water such as a river or lake in proximity to the electric power generating station, a man-made lake comprising a port and containing a body of fresh water adjoining the natural body of water, and communicating therewith by a ship channel, a conduit means for feeding hot cooling water from the generating station to the man-made lake to cool the hot cooling water therein, and a conduit means for withdrawing cool cooling water from the man-made lake and feeding it to the generating station and/or a river, lake or ocean, whereby the port in cold weather is maintained ice free because of the heat transferred to it from the hot cooling water.

The subject invention has many practical applications around the world, but particularly in the northern part of the United States and Europe and other parts of the world where rivers and lakes freeze to a non-navigable state during cold weather. The thick layer of ice on the rivers and lakes imperils ships and barges, and accordingly it is quite customary for ships and barges to be docked for the winter season, such as the southern part of the United States, where ice is not a problem. This, however, makes it necessary in springtime for the barges and ships to return north and thus lose time. By using the waste thermal energy obtained from a hot stream of cooling water a sizable port can be maintained ice free all year round adjacent to a natural river or lake. Furthermore, barges can be docked in such a man-made lake and used for grain storage and the like during the winter season so that when the ice breaks up in the rivers and lakes in the springtime the barges can be immediately transported to another port for unloading in domestic or foreign commerce. The port also provides a year round recreation area for fishing and recreation boats.

The invention will be described further in conjunction with the attached drawings, in which.

So far as is practical the same elements or parts which appear in the different views of the drawings will be identified by the same numbers.

Figure 1:
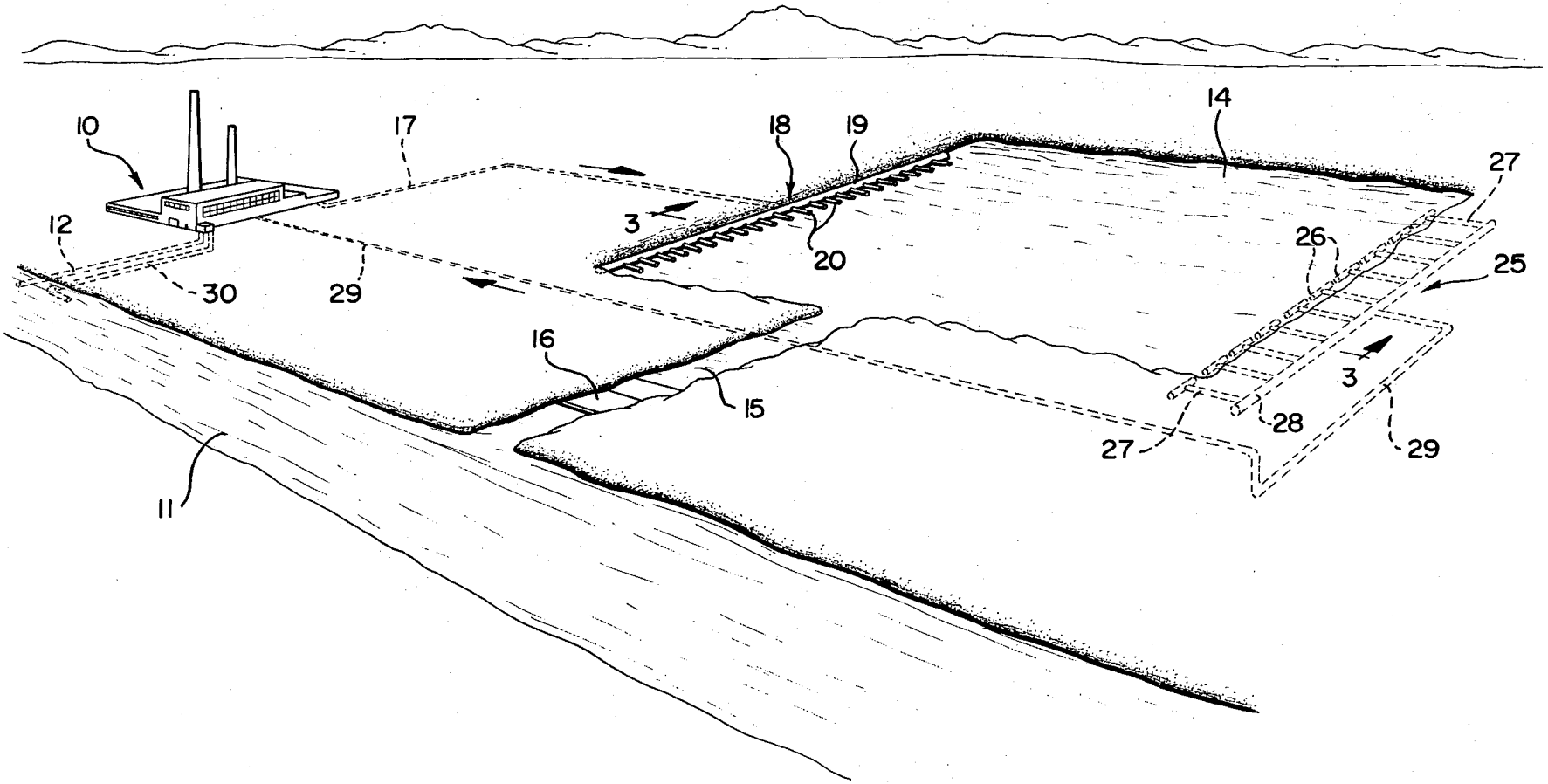
FIG. 1 is an isometric view of an industrial power plant and a cooling lake for cooling hot water received from the plant.

With reference to FIG. 1, industrial plant 10 is located close to river 11 from which cooling water can be withdrawn by means of conduit 12. Man-made lake 14 of about 100 acres and a depth of about 10 feet is in navigable communication with river 11 by means of channel 15 and ship and barge lock 16. Lock 16 may be unnecessary in some installations but is advisably included since it provides a means for controlling the flow of water from man-made lake 14 into river 11, and provides a port area safe from floods, low water and ice damage. In some instances, it is advisable and perhaps necessary for the man-made lake to be at a higher elevation than a natural body of water, such as river 11. A lock 16 would then be used in channel 15 to maintain the water level elevation in the man-made lake higher than in the natural body of water.

Further with reference to FIG. 1, conduit 17 feeds hot cooling water from industrial plant 10 to a distribution manifold 18 comprising a lateral pipe 19 and a plurality of stub pipe nozzles 20. The nozzles 20 are advisably positioned so the hot cooling water which flows from them is directed to the upper portion of the lake 14 and desirably onto the top surface of the lake water. Since manifold 18 is located along one side of lake 14, the hot cooling water distributes in a laminar flow and moves on the lake suface towards the opposite shore of the lake, thereby producing a layer of hot water at the lake surface. The heat from the surface of the hot water is rapidly dissipated by conduction and evaporation and is thereby cooled.

Figure 3:
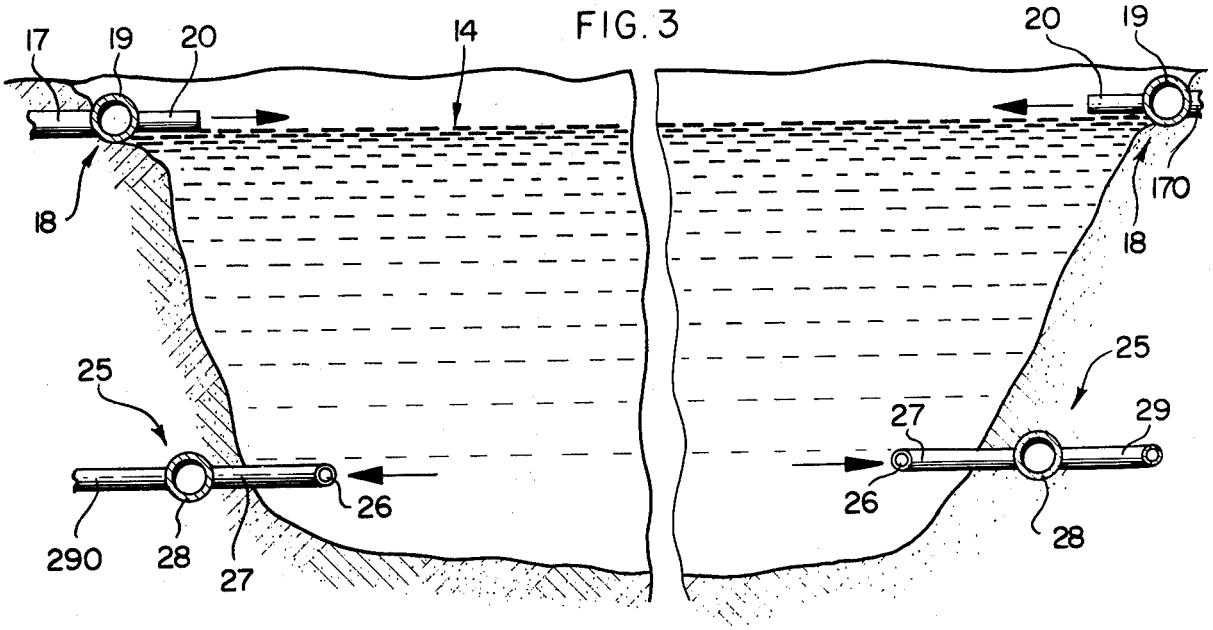
FIG. 3 is a composite sectional view taken along the line 3—3 of both of FIGS. 1 and 2.

As shown in FIGS. 1 and 3, cool cooling water is withdrawn from the opposite side of lake 14 by means of a manifold 25. The manifold 25 comprises a plurality of laterally positioned pipe sections 26 having open ends into which cool cooling water flows. The lateral pipes 26 are connected about midpoint with pipes 27 which are joined at their other end to distributor pipe 28. Return conduit 29 communicates with distributor pipe 28 and carries the cool cooling water back to industrial plant 10. Conduit 29 can, however, be put in communication with conduit 30 so that part, or all, of the cool water can be fed to river 11.

Figure 2:
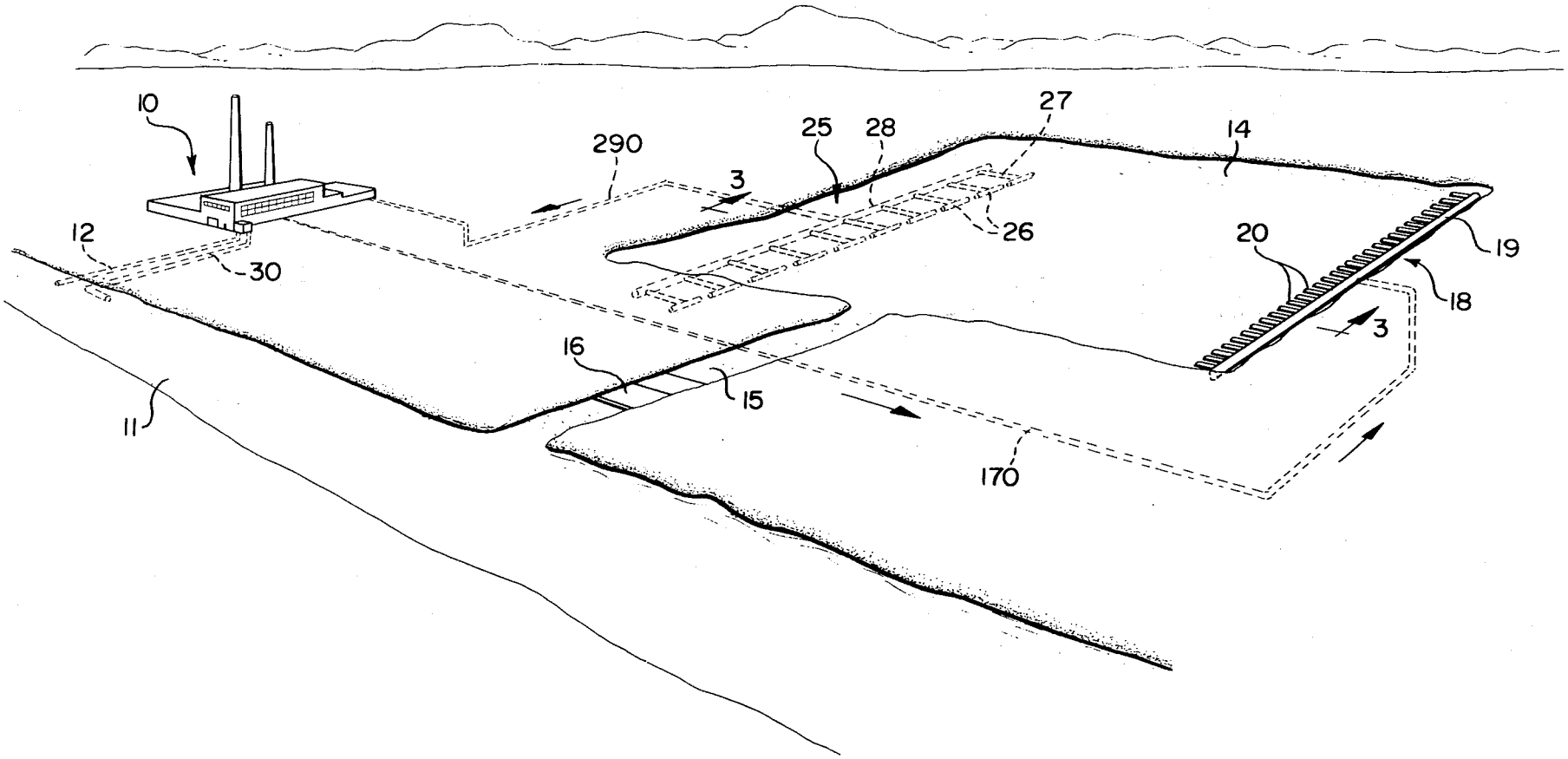
FIG. 2 is similar to FIG. 1 except that the hot cooling water is fed to the lake, and the cool cooling water is withdrawn from the lake from the opposite sides of the lake shown in FIG. 1.

The system shown in FIG. 2 is like that of FIG. 1 except that the manifold 18 for feeding hot cooling water to lake 14 is on the opposite side of the lake from that shown in the system of FIG. 1. Similarly, the manifold 25 for withdrawing cool cooling water from lake 14 is on the opposite side of the lake from that shown in FIG. 1. The hot cooling water is removed from industrial plant 10 as shown in FIG. 2 and fed by conduit 170 to the manifold 18 for distribution onto the top surface of lake 14. Furthermore, the manifold 25 used to withdraw cool cooling water from lake 14 communicates with conduit 290 as shown in FIG. 2 for feeding cool cooling water to industrial plant 10.

As will be readily apparent, either of the systems of FIGS. 1 and 2 can be used separately or they can be used in combination with the apparatus permanently installed in a manner like that illustrated by FIG. 3. With such a system the hot cooling water can be fed for a period of time to the surface on one side of the lake and cool cooling water withdrawn from the lower bottom portion of the other side of the lake.. This procedure can then be discontinued and the reverse operation initiated with hot cooling water being fed to the top surface of the lake above that shore or side from which cool cooling water was previously withdrawn. Of course, when such a reverse system is in operation the cool cooling water being withdrawn will be from the opposite side of the lake beneath the surface to which hot cooling water is fed in laminar flow in the earlier cycle of feeding water to, and withdrawing water from, cooling lake 14.

Figure 6:
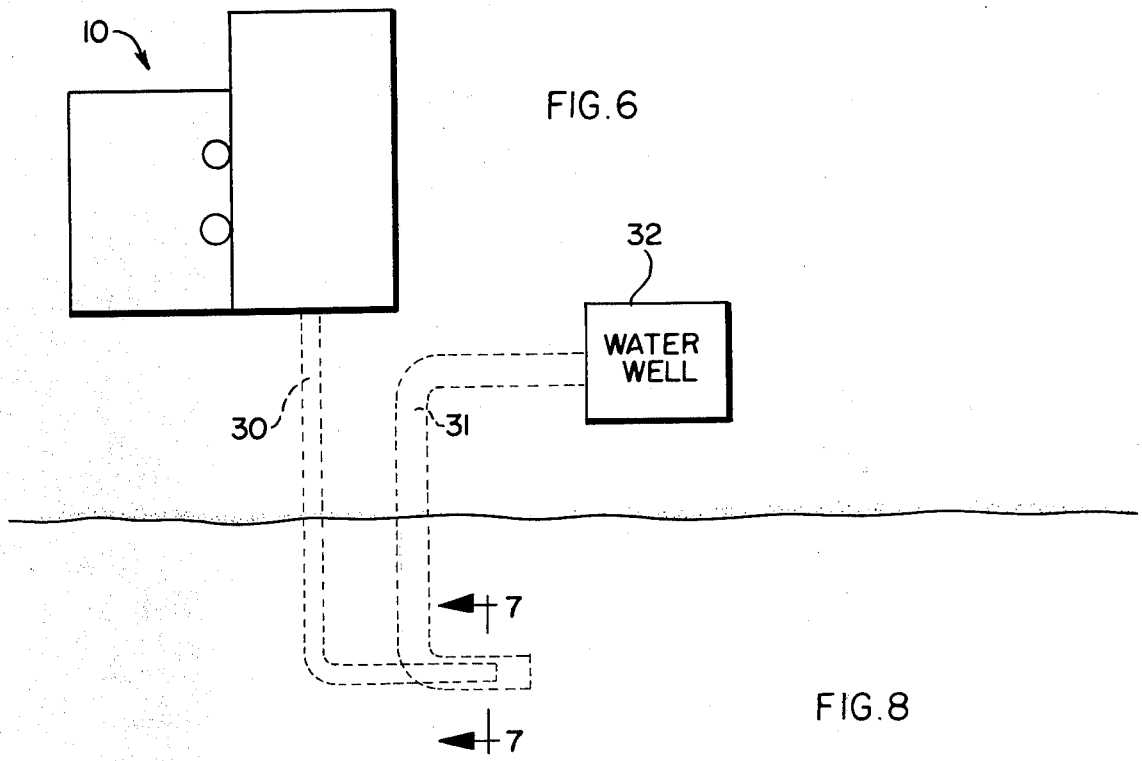
FIG. 6 is a schematic plan view of apparatus for discharging hot cooling water to a river or lake.
Figure 7:
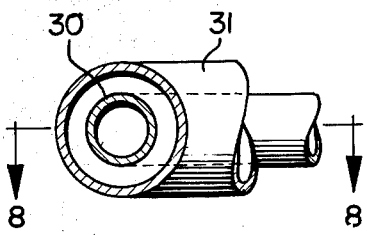
FIG. 7 is a sectional view taken along the line 7—7 of FIG. 6.
Figure 8:
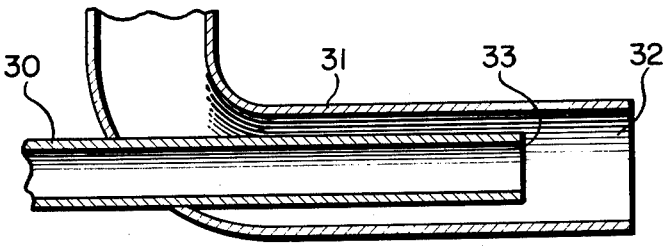
FIG. 8 is a sectional view taken along the line 8—8 of FIG. 7.

With reference to FIGS. 1 and 2, the conduit 30 may be used at various times, such as hot summer periods, to feed hot cooling water from the industrial plant 10 to river 11. To prevent the river from developing localized heated areas, a system is provided for effectively cooling such hot water as it flows downstream without causing a large part of the river from becoming hot. As shown in FIGS. 6 to 8, the end of conduit 30 may be positioned centrally inside of a conduit 31 which communicates at its other end with a well 32. The end or mouth 32 of conduit 31 extends beyond the end 33 of conduit 30 a considerable distance to facilitate enveloping the hot water with the well water. The mouths 32 and 33 are directed towards the downstream flow of water in river 11. As hot water flows through conduit 30 and out mouth 33 it becomes enveloped inside of a surrounding covering of cold well water supplied by conduit 31. The combined stream of well water with a core of hot water progresses downstream with the river flow. Heat from the central core of hot water is conducted to the surrounding layer of cold well water, and by such heat exchange the hot water becomes cooled to a temperature approximately that of the river water before it comingles with the river water and is dispersed therein. In this way, no adverse effect on the river results since the river water is not warmed to a temperature which would adversely affect the marine life in it. This way of disposing of the hot water may be used alone during hot weather periods or it may be used in combination with the described system of lake cooling.

Figure 4:
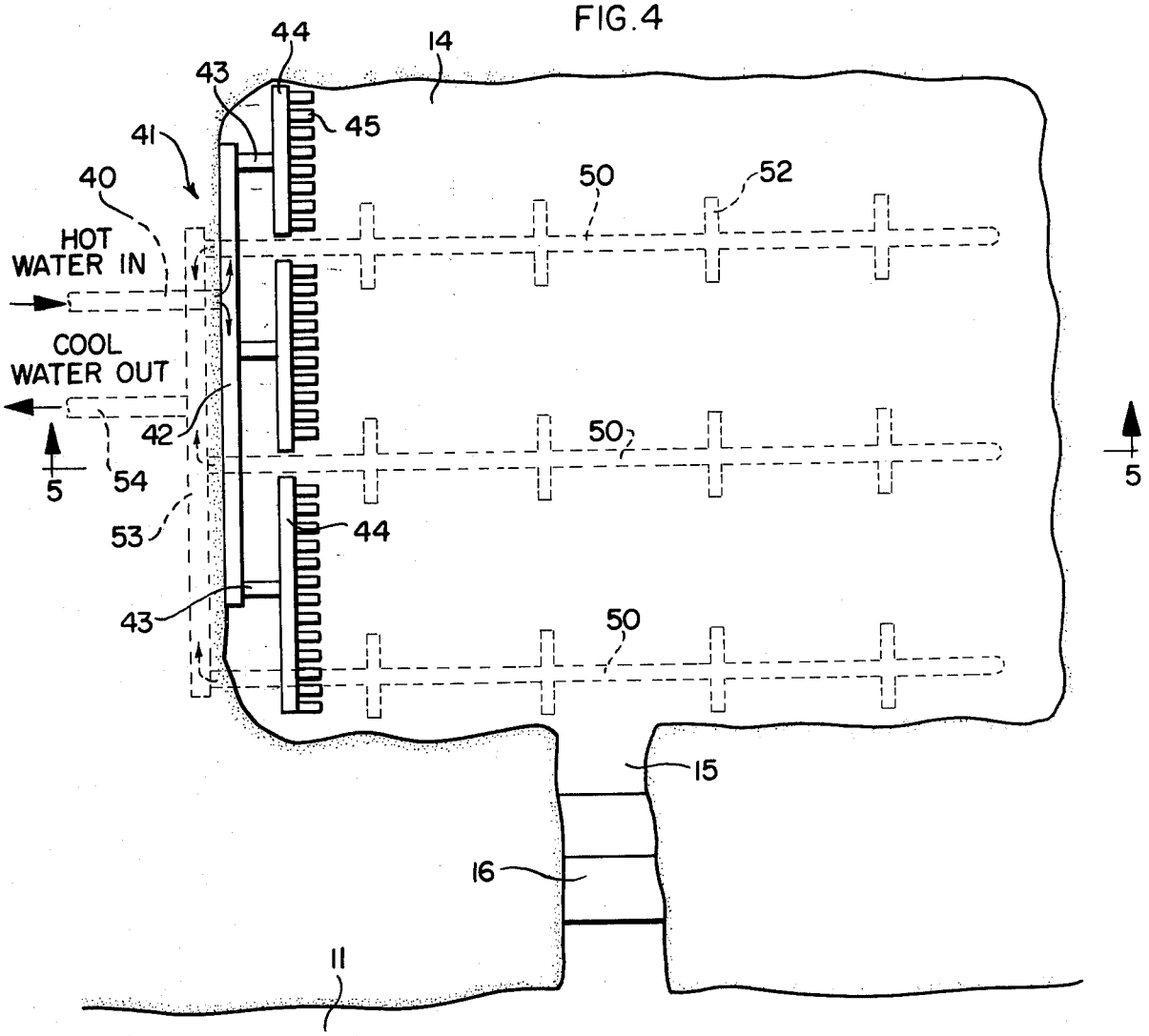
FIG. 4 is a schematic plan view of an alternative system for feeding hot cooling water to a cooling lake and removing cool cooling water from it.
Figure 5:
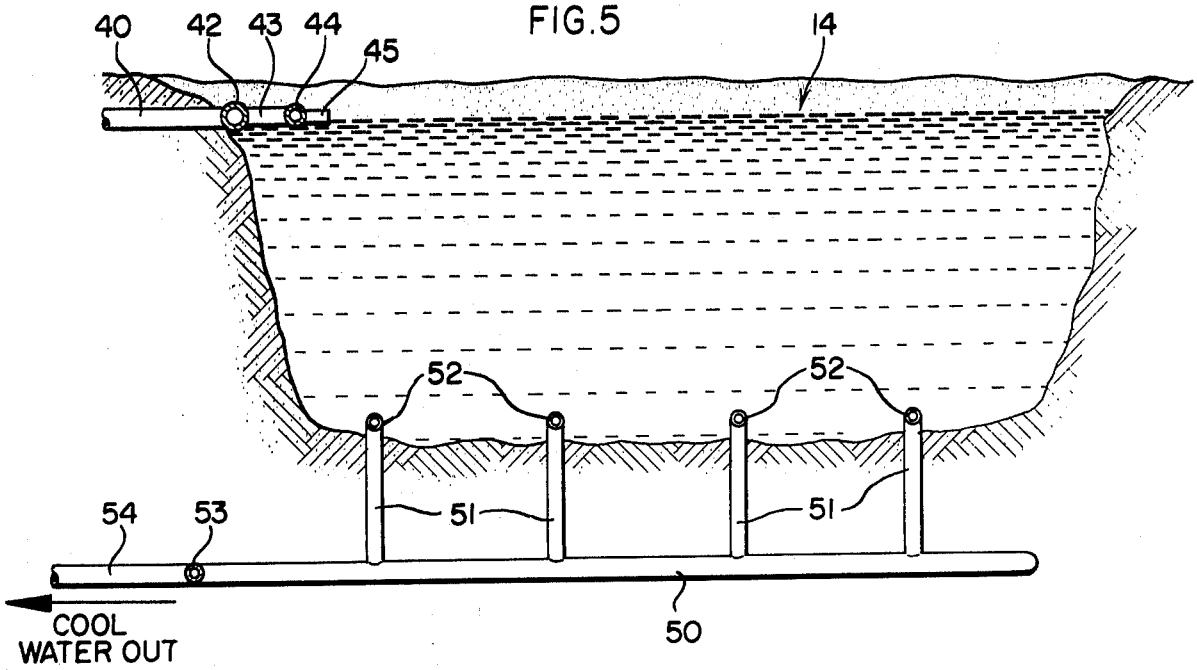
FIG. 5 is a sectional view taken along the line 5—5 of FIG. 4.

FIGS. 4 and 5 of the drawings illustrate another embodiment of the invention. Hot cooling water from an industrial plant is fed by conduit 40 to distribution manifold 41. The manifold 41 comprises a lateral pipe 42 to which a plurality of pipes 43 are joined in communication. Pipes 43 in turn are connected to pipes 44 from which a plurality of short nozzle pipes 45 extend. As hot cooling water flows from the nozzle pipes 45 it is deposited on the surface of lake 14 as a hot water layer which flows across the surface towards the opposite shore of the lake. By evaporation and conduction the hot water is effectively cooled rapidly.

Also as shown in FIGS. 4 and 5, a plurality of parallel pipes 50 extend beneath the bottom of lake 14. Vertical pipes 51 extend upwardly from each of the horizontal pipes 50. At the top of each pipe 51 there is located a horizontal pipe 52 which is open at both ends and through which openings cool cooling water enters from the lake. The cool cooling water flows from pipes 52 down pipes 51 into pipes 50 which carry the water to a distributor pipe 53 from which the cool cooling water is fed to conduit 54 by it to industrial plant 10.

A warm water port in a cold climate can reduce the cost of operating an industrial plant, including an electric generating station, by an amount equal to the profit which results from the port operation. Barges and ships in the ice-free port may be loaded during the winter months, sales negotiated and the barges and ships moved out as soon as the ice in the navigable river or lake is gone.

The useful life of a man-made lake port will generally exceed 50 years, which is much longer than the 20 year useful life of a cooling tower. The capital investment and operating cost for a man-made cooling lake will also be much less than for a cooling tower. This will thus make possible lower cost operation of the industrial plant and, in the case of an electric generating station, will lead to lower cost electricity.

The foregoing detailed description has been given for clearness of understanding only, and no unnecessary limitations should be understood therefrom, as modifications will be obvious to those skilled in the art.

What is claimed is:

1. A system for thermal disposal and port improvement comprising:

an industrial plant constituting a source of hot cooling water which must be cooled located along a navigable river, lake or ocean, a body of water, constituting a port in the vicinity of the industrial plant, separate from but in navigable communication with the river, lake or ocean, means for delivering hot cooling water from the industrial plant to the port water to cool the water throughout the year and to prevent it from freezing shut in winter, and means for removing cool cooling water from the port water and delivering it to the industrial plant and/or to a river, lake or ocean.

2. A system according to claim 1 in which the hot cooling water is delivered to the top portion of the port water and the cool water is removed from the bottom portion of the port water.

3. A system according to claim 1 including a conduit by which hot cooling water from the industrial plant or the port is fed to a river, lake or ocean, the end of the conduit is positioned in and near the end of a larger pipe having means by which cold water can be fed out it cocurrent with the hot cooling water so that the stream fed to the river, lake or ocean constitutes a layer of cold water around a hot water core.

4. A system comprising:

a conduit extending from land to a river, lake or ocean for feeding hot water thereto, said conduit terminating in an end portion in the river, lake or ocean, and a larger pipe surrounding the end portion of the conduit and in liquid communication with a source of cold water, said larger pipe having an end adjacent or beyond the conduit end, whereby cold water can be fed out the larger pipe cocurrent with the hot water so that the stream fed to the river, lake or ocean constitutes a layer of cold water around a hot water core.

5. In combination, an electric power generating station, a natural body of water such as a lake, river or ocean in proximity to the electric power generating station, a man-made lake comprising a port and containing a body of fresh water adjoining the natural body of water, and communicating therewith by a ship channel, a conduit means for feeding hot cooling water from the generating station to the man-made lake to cool the hot water therein, and a conduit means for withdrawing cool cooling water from the man-made lake and feeding it to the generating station and/or to a river, lake or ocean;

whereby a port in cold weather is maintained ice free because of the heat transferred to it from the hot cooling water.

6. A combination according to claim 5 in which the conduit means for feeding hot cooling water to the man-made lake includes nozzles which discharge the hot cooling water in laminar flow on the top of the lake directed from one side across the lake towards the other side.

7. A combination according to claim 5 in which the conduit means for withdrawing cool cooling water from the man-made lake includes inlet openings located near the lake bottom.

8. A combination according to claim 5 in which a ship lock is located in the ship channel to prevent uncontrolled water flow between the man-made lake and the natural body of water.

9. A combination according to claim 8 in which the man-made lake is at a higher elevation than the natural body of water.

10. A combination according to claim 5 in which the natural body of water is a fresh water river or lake which normally is covered by heavy ice for part of the year.

11. A combination according to claim 6 in which the conduit means for withdrawing cool cooling water from the man-made lake includes inlet openings located near the lake bottom.

12. A combination according to claim 5 in which the conduit means for feeding hot cooling water to the man-made lake includes alternate means for discharging the hot cooling water in laminar flow on top of the lake directed from a first side towards a second side of the lake, and from the second side of the lake to the first side of the lake.

13. A combination according to claim 12 in which the conduit means for withdrawing cool cooling water from the man-made lake includes inlet openings located near the lake bottom.

14. A combination according to claim 13 in which inlet openings are located on both the first side and the second side of the lake, and means regulating flow of cool water into the inlet openings only on the side of the lake opposite the side on which hot cooling water is discharged onto the lake surface.

15. In combination, an industrial plant, a man-made lake containing a body of fresh water, a conduit means for feeding hot cooling water from the industrial plant to the top portion of the man-made lake to cool the hot water, and a conduit means for withdrawing cool cooling water from the bottom portion of the man-made lake and feeding it to the industrial plant.

16. A system according to claim 15 including a conduit by which hot cooling water from the industrial plant or the port is fed to a river, lake or ocean, the end of the conduit is positioned in and near the end of a larger pipe having means by which cold water can be fed out it cocurrent with the hot cooling water so that the stream fed to the river, lake or ocean constitutes a layer of cold water around a hot water core.

17. A combination according to claim 15 in which the conduit means for feeding hot cooling water to the man-made lake includes nozzles which discharge the hot cooling water in laminar flow on the top of the lake directed from one side across the lake towards the other side.

18. A combination according to claim 15 in which the conduit means for withdrawing cool cooling water from the man-made lake includes inlet openings located near the lake bottom.

19. A combination according to claim 15 in which the conduit means for feeding hot cooling water to the man-made lake includes alternate means for discharging the hot cooling water in laminar flow on top of the lake directed from a first side towards a second side of the lake, and from the second side of the lake to the first side of the lake.

20. A method of cooling hot cooling water from an industrial plant, which comprises:

removing hot cooling water as an effluent stream from an industrial plant, directing the stream of hot cooling water to the top portion of a holding and cooling lake open to the atmosphere to effect reduction of the temperature of the hot cooling water by evaporation and conduction, and withdrawing cool cooling water from the bottom portion of the lake and sending it back to the industrial plant for cooling purposes and/or to a river, lake or ocean.

21. A method according to claim 20 in which the hot cooling water is fed to the top portion of one side of the lake to form a hot cooling water layer thereon and the cool cooling water is withdrawn from the bottom portion of the opposite side of the lake.

22. A method according to claim 20 in which the hot cooling water is fed to the top portion of the lake by a plurality of spaced-apart hot water distribution pipe outlets, and the cool cooling water is withdrawn from the bottom portion of the lake through a plurality of spaced-apart cool water inlets.

23. A method according to claim 20 in which the lake constitutes a ship and barge port in navigable water communication with a river or another lake or ocean.

24. A method according to claim 23 in which the lake receiving the hot cooling water is at a higher elevation than the navigable water.

25. A method according to claim 20 in which the industrial plant is an electric generating plant.

26. A method comprising withdrawing hot cooling water from an industrial plant or a cooling lake and feeding it by a conduit to empty into a river, placing a layer of cold water from an external source and colder than the river water as a continuous stream around and enveloping the hot cooling water as it flows from the conduit thereby cooling the hot cooling water by conduction with the stream of cold water before it mixes with the river water.

27. A system for thermal disposal and port improvement comprising:

an industrial plant constituting a source of hot cooling water which must be cooled located along a navigable river, lake or ocean, a body of water constituting a port in the vicinity of the industrial plant and in navigable communication with the river, lake or ocean, means for delivering hot cooling water from the industrial plant to the top portion of the port water to cool the water throughout the year and to prevent it from freezing shut in winter, and means for removing cool cooling water from the bottom portion of the port water and delivering it to the industrial plant and/or to a river, lake or ocean.

* * * * *